US011988213B2

(12) United States Patent
De Raeve et al.

(10) Patent No.: US 11,988,213 B2
(45) Date of Patent: May 21, 2024

(54) MULTISTAGE PUMP AND SUBSEA PUMPING ARRANGEMENT

(71) Applicant: Sulzer Management AG, Winterthur (CH)

(72) Inventors: Karel De Raeve, Winterthur (CH); Simon Gassmann, Zürich (CH); Bartosz Kus, Kalisz (PL); Thomas Felix, Leeds (GB)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 16/936,474

(22) Filed: Jul. 23, 2020

(65) Prior Publication Data

US 2021/0033095 A1 Feb. 4, 2021

(30) Foreign Application Priority Data

Jul. 31, 2019 (EP) ..... 19189409

(51) Int. Cl.
*F04D 13/08* (2006.01)
*F04D 1/06* (2006.01)
(Continued)

(52) U.S. Cl.
CPC ..... *F04D 13/08* (2013.01); *F04D 1/06* (2013.01); *F04D 13/12* (2013.01); *F04D 29/043* (2013.01)

(58) Field of Classification Search
CPC . F04D 1/06; F04D 13/08; F04D 13/12; F04D 29/043
See application file for complete search history.

(56) References Cited

U.S. PATENT DOCUMENTS 5,846,052 A * 12/1998 Kameda ..... F04D 1/06 415/182.1
6,224,355 B1 5/2001 Forthuber
(Continued)

FOREIGN PATENT DOCUMENTS

BR 102016014783 A2 1/2017
BR 102014002291 A2 7/2017
(Continued)

OTHER PUBLICATIONS

European Search Report issued Jan. 22, 2020 in corresponding European Patent Application No. 19189409.6 filed Jul. 31, 2019.

*Primary Examiner* — Connor J Tremarche
(74) *Attorney, Agent, or Firm* — GLOBAL IP COUNSELORS, LLP

(57) ABSTRACT

A multistage pump for installation on a sea ground includes a common housing, a pump unit arranged in the common housing, a drive unit arranged in the common housing, and a coupling. The common housing includes a pump inlet and a pump outlet, the pump unit including a plurality of impellers to convey a compressible fluid from the pump inlet to the pump outlet, and a pump shaft, on which each impeller is mounted, each impeller being a radial or semi-axial impeller. The drive unit includes a drive shaft to drive the pump shaft, and an electric motor configured to rotate the drive shaft about an axial direction. The coupling couples the drive shaft to the pump shaft. The pump unit conveys the fluid in a dense phase at the pump outlet, and at least two impellers of the plurality of impellers have a different specific speed.

11 Claims, 5 Drawing Sheets

(51) Int. Cl.
*F04D 13/12* (2006.01)
*F04D 29/043* (2006.01)

(56) References Cited

U.S. PATENT DOCUMENTS

| | | | | |
|---|---|---|---|---|
| 8,632,320 | B2 * | 1/2014 | Palomba | F04D 19/02 417/372 |
| 9,458,863 | B2 | 10/2016 | Bergamini et al. | |
| 9,719,523 | B2 | 8/2017 | Jayaram et al. | |
| 9,841,026 | B2 * | 12/2017 | Stinessen | F04D 1/06 |
| 2007/0200438 | A1 * | 8/2007 | Kaminski | F04D 17/122 310/59 |
| 2009/0317248 | A1 * | 12/2009 | Tanaka | F04D 29/441 415/224.5 |
| 2012/0057965 | A1 | 3/2012 | Bergamini et al. | |
| 2012/0111419 | A1 | 5/2012 | Schwarz | |
| 2015/0260190 | A1 * | 9/2015 | Bergamini | F04D 29/106 415/203 |
| 2015/0308446 | A1 | 10/2015 | Koivikko et al. | |
| 2016/0003255 | A1 | 1/2016 | Corneliussen et al. | |
| 2016/0053764 | A1 | 2/2016 | Abdelwahab et al. | |
| 2016/0333677 | A1 * | 11/2016 | Westberg | F04D 13/086 |
| 2017/0191480 | A1 * | 7/2017 | Lagas | F04D 29/22 |
| 2018/0231013 | A1 * | 8/2018 | Trottmann | F04D 29/708 |

FOREIGN PATENT DOCUMENTS

| | | | |
|---|---|---|---|
| EP | 3102833 | B1 | 3/2021 |
| WO | 2015/114136 | A1 | 8/2015 |

* cited by examiner

MULTISTAGE PUMP AND SUBSEA PUMPING ARRANGEMENT

CROSS-REFERENCE TO RELATED APPLICATION

This application claims priority to European Patent Application No. 19189409.6, filed Jul. 31, 2019, the contents of which are hereby incorporated herein by reference in their entirety.

BACKGROUND

Field of the Invention

The invention relates to a multistage pump configured for installation on a sea ground and to a subsea pumping arrangement comprising at least two of these multistage pumps.

Background Information

Multistage pumps for conveying a fluid are used in many different industries, in particular for applications where high pressure is generated. A multistage pump comprises a plurality of impellers, which are arranged on a common shaft. The common shaft is driven for a rotation about an axial direction so that all impellers are commonly rotated about the axial direction. One important industry, in which multistage pumps are used, is the oil and gas processing industry, where multistage pumps are designed, e.g. for conveying hydrocarbon fluids, for example for extracting crude oil from an oil field or for transportation of oil/gas through pipelines or within refineries. Another application of multistage pumps in the oil and gas industry is the injection of a process fluid, in most cases water and, in particular seawater, into an oil reservoir. For such applications, the pumps are designed as (water) injection pumps supplying seawater at high pressure to a well that leads to a subterranean region of an oil reservoir. A typical value for the pressure increase generated by such an injection pump is 200-300 bar (20-30 MPa) or even more.

SUMMARY

In view of an efficient exploitation of oil and gas fields, there is nowadays an increasing demand for pumps that can be installed directly on the sea ground in particular down to a depth of 100 m, down to 500 m or even down to more than 1,000 m beneath the water surface. Needless to say that the design of such pumps is challenging, in particular because these pumps operate in a difficult subsea environment for a long time period with as little as possible maintenance and service work. This requires specific measures to minimize the amount of equipment involved and to optimize the reliability of the pump.

In particular, in deepwater oil fields there are massive amounts of carbon dioxide ($CO_2$) and natural gas on top of the crude oil. The carbon dioxide and the natural gas, which contains methane ($CH_4$), are usually separated from the oil. This is usually done at the water surface (topside) on an FPSO (floating production storage and offloading) unit or onshore. The separated gas can be compressed and reinjected into the reservoir in order to maintain the reservoir pressure or the gas is injected into exhausted gas reservoirs to be stored in the ground. The reinjection into oil reservoirs is a well-known method for increasing the recovery of hydrocarbons from an oil or gas field. The injected fluid maintains or increases the pressure in the reservoir thereby driving the oil or the hydrocarbons towards and out of the production well. This process is known as enhanced oil recovery (EOR).

The separation, treatment and reinjection of carbon dioxide/natural gas at the topside, i.e. on a FPSO unit or in an onshore facility requires a significant amount of space. This amount can be for example 70% of the required topside space. One of the main reasons is the low density of the gas at the topside operation pressures. Therefore, to improve the process, the idea of separating the carbon dioxide/natural gas/methane from the oil at a subsea location, e.g. on the sea ground, was proposed. Thus, the crude oil containing the light components such as carbon dioxide, methane, ethane is separated at the sea ground into a heavier liquid enriched phase, which is delivered to a topside location, and into a lighter $CO_2$ and $CH_4$ enriched phase, which is reinjected into a subterranean region, e.g. the oil reservoir. Due to the hydrostatic pressure at the sea ground the separation will take place for many applications at a pressure and temperature where carbon dioxide is in the supercritical state or in the dense phase.

The dense phase or supercritical phase for a pure fluid is the region beyond the critical point, namely the fluid region where the pressure is higher as the critical pressure and the temperature is higher as the critical temperature.

Basically, both terms "supercritical phase" and "dense phase" designate the same state of matter. Thus, from a physical point of view both terms are synonyms and they will be use as synonyms within the scope of this application. Beside the solid, the liquid and the gaseous state the dense phase or the dense fluid phase is another state of matter, which is characterized by a viscosity similar to that of a fluid in the gaseous phase, but a density closer to that of a fluid in the liquid phase.

Although "supercritical phase (state)" and "dense phase (state)" are synonyms from the physical perspective, they are used—as a kind of convention—with slightly different meaning: the tendency is to use the term "supercritical phase" for a single component fluid (also referred to as pure fluid), and the term "dense phase" fluid for a multi-component fluids.

For a better understanding, FIG. 4 shows as a schematic example of the phase diagram of pure $CO_2$ (single component fluid). The horizontal axis T indicates the temperature in degrees Celsius, and the vertical axis P indicates the pressure in MPa. The Line SL indicates the phase boundary between the solid phase and the liquid phase. The line SG indicates the phase boundary between the solid phase and the gaseous phase. The line LG indicates the phase boundary between the liquid and the gaseous phase. The point TP is the triple point and the point CP is the critical point. The region SC indicates the area where the fluid is in the supercritical state or supercritical phase.

The process fluid in typical $CO_2$ pumping applications is often a mixture of several components. A typical example of such a mixture is a mixture of $CO_2$ and natural gas.

Natural gas itself is already a mixture of several components such as methane, ethane, propane and so on. Fluid mixtures such as natural gas have a phase envelope in which the liquid phase and the gaseous or vapor phase are in equilibrium with each other over a range of temperature, pressure and composition. In this region the two phases coexist. This equilibrium region is a two-phase region having a liquid and a gaseous phase. The gaseous phase can also be called the vapor phase or the gas phase.

FIG. 5 shows in a schematic representation a typical phase diagram of a multi-component fluid at one defined composition. The horizontal axis T again indicates the temperature, wherein the temperature is increasing to the right. The vertical axis P again indicates the pressure wherein the pressure is increasing upwardly. The region EQ indicates the region where the liquid phase and the gaseous phase coexist. The line DP indicates the dew point curve, which is the boundary between the region EQ and the gaseous phase. The line BP indicates the bubble point curve, which is the boundary between the region EQ and the liquid phase. The curves FL between the line BP and the line DP indicate different molar fractions of the liquid in the equilibrium region EQ.

The dense phase region SC for such a multi-component fluid is beyond the critical point CP and the phase envelope built by the dew point curve DP and the bubble point curve BP, namely above the critical pressure and the critical temperature and outside the phase envelope.

It is only inside the envelope delimited by the bubble point curve BP and dew point curve DP that there is a two phase equilibrium of the liquid and gaseous phase.

Outside of this envelope, the fluid is in single phase condition, namely single phase liquid phase, single phase gaseous phase or single phase dense phase.

An example of a pumping application of a single phase, dense phase $CO_2$ rich multi-component fluid can be found in the upstream offshore oil and gas industry.

As already mentioned in a subsea oil and gas field exploitation the lighter $CO_2$ enriched phase contains a considerable amount of other components, predominantly $CH_4$. This lighter fluid phase as a whole is a mixture of different components and is quite often in the dense phase SC at a temperature and pressure which is above the critical point CP of the multi-component fluid. A typical operation pressure for the separation into the lighter phase and the heavier phase can be for example around 200 bar (20 MPa) where the mixture of carbon dioxide with natural gas can have a density of which is higher than 200 kg/m$^3$, e.g. approximately 400 kg/m$^3$. This means, that the lighter phase has a density at the sea ground, which is a few hundred times larger than the density of air at normal conditions. In addition, the lighter $CO_2$ and $CH_4$ enriched fluid being in the dense phase has a viscosity which is comparable to the viscosity of a gas, a density which is comparable to the density of a liquid and a compressibility, which is comparable to the compressibility of a gas. Thus, there is a need for a subsea pump that can reinject such a compressible fluid in a subterranean region.

The embodiments of the present invention described herein address this need.

Therefore, the invention improves over the state of the art and includes a multistage pump, which is suited for subsea applications and for deployment on the sea ground, and which is suited to be configured as an injection pump for injecting a compressible fluid being in the dense phase in a subterranean region. Furthermore, the invention can be a subsea pumping arrangement comprising such a multistage pump.

The subject matter of the invention satisfying these objects is characterized by the features disclosed herein.

Thus, according to embodiments of the invention, a multistage pump is proposed, configured for installation on a sea ground, having a common housing, a pump unit arranged in the common housing, and a drive unit arranged in the common housing, wherein the common housing comprises a pump inlet and a pump outlet, wherein the pump unit comprises a plurality of impellers for conveying a compressible fluid from the pump inlet to the pump outlet, and a pump shaft, on which each impeller is mounted, wherein each impeller is configured as a radial or semi-axial impeller, wherein the drive unit comprises a drive shaft for driving the pump shaft, and an electric motor for rotating the drive shaft about an axial direction, wherein a coupling is provided for coupling the drive shaft to the pump shaft, wherein the pump unit is configured for conveying the fluid being in the dense phase at the pump outlet, and wherein at least two impellers of the plurality of impellers have a different specific speed.

It was discovered that the particular combination of a multistage pump having only radial or semi-axial impellers provided excellent results in view of conveying such compressible fluids being in the dense phase at the discharge side, i.e. at the pump outlet, and containing a considerable amount of $CO_2$ under subsea conditions. This is surprising and unexpected because for other subsea applications where fluids with high compressibility have to be pumped, e.g. in multi-phase pumps, it is the prevailing opinion that a helico-axial pump design is superior.

In order to even increase the efficiency of the multistage pump, it is advantageous, when at least two impellers of the plurality of impellers have a different specific speed. The fluid in the dense phase is a compressible fluid having quite a low viscosity, quite a high density (comparable to a liquid), and a compressibility comparable to a gas. Due to the high compressibility of the compressible fluid in the dense phase the volume flow at the pump outlet is different from the volume flow at the pump inlet. Because of this change in the volume flow the efficiency of the multistage pump can be increased by using impellers having different specific speeds.

It has to be noted that the fluid is in the dense phase when leaving the pump, i.e. at the pump outlet. It is possible, but not at all required, that the fluid is already in the dense phase, i.e. in the supercritical state, when entering the pump, i.e. at the pump inlet. It is also possible that the fluid is not yet in the dense phase when entering the pump and changes to the dense phase when acted upon by the impellers, so that the fluid is in the dense state when leaving the pump.

A particular advantage of the multiphase pump according to embodiments of the invention is the fact that the pump can convey the supercritical fluid over the whole dense phase of the fluid without having to limit the pump operating range to a sub-range of the dense phase region as it is described for example in US2012/111419. Furthermore, the multistage pump according to embodiments of the invention does not require any complex control algorithms in combination e.g. with a compressor.

Within the scope of this application the term "compressible fluid" is used for a fluid having a specific gravity relative to water, which is at most 0.9, and preferably at least 0.2 and at most 0.8. As it is commonly used in the art, the specific gravity is the ratio of the density of the fluid to the density of a reference substance. Within the scope of this application the reference fluid is water.

In addition, it is preferred that the "compressible fluid" has a dynamic viscosity, which is comparable to the viscosity of a gas, and preferably at least 0.005 mPa·s and at most 0.1 mPa·s. The SI unit Millipascal times second corresponds to the also used unit Centipoise (cP), i.e. 1 mPa·s equals 1 cP.

Furthermore, the term "compressible fluid" also encompasses a fluid in the supercritical stage, or the dense phase, respectively. Each fluid in the supercritical phase, i.e. in the dense phase, is a compressible fluid as defined hereinbefore.

Preferably the multistage pump is configured as an injection pump for injecting the compressible fluid being in the dense state, e.g. a mixture containing carbon dioxide, into a subterranean region. By this measure it is no longer necessary to transport the gas-liquid mixture from the subsea location to a topside location, to at least partially remove the carbon dioxide, to compress the carbon dioxide and to transport the carbon dioxide back to a subsea location for the injection into a reservoir.

Preferably, the pump outlet is the only opening through which the conveyed fluid can exit the common housing, i.e. it is preferred that the multistage pump has no intermediate outlet for the compressible fluid.

It is preferred that the plurality of impellers comprises a first stage impeller and a last stage impeller, wherein the last stage impeller has a lower specific speed than the first stage impeller. Since the volume flow at the pump outlet is smaller than the volume flow at the pump inlet due to the compression of the compressible fluid by the pressure rise along the stages of the pump, the last stage impeller with a lower specific speed increases the efficiency of the multistage pump.

According to a preferred design the multistage pump comprises a balance drum, also referred to as a throttle bush, which is fixedly connected to the pump shaft between the pump unit and the coupling, the balance drum defining a front side facing the pump unit and a back side, wherein a relief passage is disposed between the balance drum and a stationary part configured to be stationary with respect to the common housing, the relief passage extending from the front side to the back side, and wherein a balance line is provided and configured for the recirculation of the fluid from the back side to a low pressure side of the multistage pump. By providing the balance drum at the pump shaft the axial thrust generated by the impellers during operation of the multistage pump is at least partially compensated by the pressure drop over the balance drum. This measure considerably reduces the load that has to be carried by the axial or thrust bearing(s).

Furthermore, it is a preferred design that the plurality of impellers comprises a first set of impellers and a second set of impellers wherein the first set of impellers and the second set of impellers are arranged in a back-to-back arrangement, so that an axial thrust generated by the first set of impellers is directed opposite to an axial thrust generated by the second set of impellers.

Regarding the back-to-back design it is advantageous to provide a center bush, which is fixedly connected to the pump shaft between the first set of impellers and the second set of impellers, wherein a balancing passage is provided between the center bush and a second stationary part configured to be stationary with respect to the common housing. The center bush with the balancing passage also contributes to reduce the overall axial thrust acting upon the pump shaft.

In addition, the center bush and/or the balance drum (throttle bush) support the rotordynamic stability both with respect to stiffness and damping in particular of rotor vibrations. The rotor is the entity of the rotating parts of the pump unit, i.e. in particular all impellers as well the pump shaft are part of the rotor of the pump unit.

According to a preferred embodiment the multistage pump is configured as a vertical pump with the pump shaft extending in the direction of gravity, wherein the drive unit is arranged on top of the pump unit.

Particularly preferred, the multistage pump is configured to inject a mixture containing at least 20 mol % carbon dioxide into a subterranean region. Typically such a mixture contains—beside carbon dioxide—a considerable amount of natural gas. The natural gas usually has methane $CH_4$ as the main constituent. Just as an example the mixture can comprise 53 mol % $CO_2$ and 43 mol % $CH_4$. In another example the mixture can contain 38 mol % $CO_2$ and 37 mol % $CH_4$.

The multistage pump according to embodiments of the invention is particularly suited for reinjecting a $CO_2$ rich mixture being in the dense state into the oil and gas reservoir, e.g. to maintain the pressure in the reservoir.

Usually the crude oil discharged through the well head comprises a heavier liquid enriched phase, which is delivered to a topside location, and a lighter $CO_2$ and $CH_4$ enriched phase, which is reinjected into a subterranean region, e.g. the oil reservoir, The pressures at the well head at a subsea location can be 10 MPA (100 bar) or even a multitude of this pressure. At these high pressures, the well is usually delivering a mixture of the two immiscible phases, namely the $CO_2$ rich fluid being in the dense phase and the liquid phase of hydrocarbons.

The two immiscible phases, one of which is rich in $CO_2$ and in the dense phase, and the other one is rich in (esp. higher) hydrocarbons and in the liquid state, can be separated e.g. by gravity with the aid of gravitational separators.

This subsea separation process where the dense phase $CO_2$ rich fluid is separated from the hydrocarbons in liquid phase is described e. g. in BR 102014002291.

The $CO_2$ rich fluid in dense phase has a significantly higher density than the $CO_2$ in a gaseous phase. This has the advantage that much smaller equipment can be used for the separation on the seabed at high pressure as compared to the size of the equipment that would be required if the separation would take place at low pressure e.g. on the topside of a platform. This is because the equipment can be configured for much smaller volume flow rates.

For the reinjection of the $CO_2$ rich fluid in the dense phase, the multistage pump according to embodiments of the invention can be used instead of a compressor, which is much more economic, in particular from the energy efficiency perspective.

The required pressure rise for the reinjection is also significantly smaller, since the pressure difference between the injection pressure and the pressure of the $CO_2$ rich phase in the dense phase is also much smaller than the pressure difference between the injection pressure and a $CO_2$ rich phase in the gaseous phase Another application of the multistage pump according to the invention is the transport of $CO_2$ in the dense phase or natural gas in the dense phase or a mixture of both in the dense phase. There are several reasons why transport in a dense phase is preferred over transport in a gaseous phase. The volume flow for the same mass flow is smaller, which means that smaller pipelines can be used and that there is a smaller pressure drop in the pipelines. Another advantage is that supercritical $CO_2$, i.e. dense phase CO2 in the dense phase or natural gas in the dense phase have the capabilities of dissolving a certain amount of water. Unlike in the gaseous phase there is no risk that the entrained water drops out and accumulates in the low points of the pipeline, so called liquid hold up. This water accumulation in low points causes significant problems in winter time, since gas hydrates can form and accumulate at these points and gradually close off the pipeline.

The efficient and effective transport of $CO_2$ over long distances is gaining more and more importance given the current developments in CCS (carbon capture and storage) and CCSU (carbon capture, storage and utilization).

The injection of $CO_2$ into oil reservoirs is also used as an enhanced oil recovery method. For onshore oil production, this often requires extensive infrastructure to transport the $CO_2$ from the source to the injection wells.

Another application, where $CO_2$ in the dense phase has to be conveyed, is the use of $CO_2$ as a supercritical solvent in the food processing industry e.g. for the extraction of solutes.

According to a preferred design the multistage pump according to embodiments of the invention is configured as a single phase pump for conveying a single phase fluid.

Within this application a "single phase fluid" designates a fluid being in one state of matter. Thus, a single phase fluid is for example a liquid, a gas or a fluid in the dense phase. It has to be noted that a single phase fluid can contain entrainments of another phase. It is known in the art that every single phase liquid pump, can handle a small fraction of a gas phase entrainment. In an analogous manner a single phase dense fluid pump can handle also a small fraction of a liquid entrainment.

The term single phase fluid shall be understood in this manner, namely that the single phase fluid can contain entrainments of one or more other phase(s), for example up to 5 Mol % or up to 5 Vol %.

The primary purpose of a single-phase pump is to pump a single phase fluid.

In addition, according to embodiments of the invention a subsea pumping arrangement is proposed, configured for installation on a sea ground, comprising at least a first multistage pump and a second multistage pump, wherein each multistage pump is configured according to embodiments of the invention, and wherein the first multistage pump and the second multistage pump are arranged in series.

In particular for such applications where a large pressure is required at the high pressure side, it might be advantageous to connect at least two multistage pumps, which are designed according to the invention, to a subsea pumping arrangement, rather than adding additional stages to a single multiphase pump. The at least two multistage pumps are arranged in series. The pump outlet of the first multistage pump is connected to the pump inlet of the second multistage pump. In some embodiments the pump outlet of the first multistage pump is directly connected to the pump inlet of the second multistage pump, e.g. by a piping. In other embodiments one or more additional device(s) is/are arranged between the pump outlet of the first multistage pump and the pump inlet of the second multistage pump, for example a cooling device and/or a buffer device.

Regarding the design of the impellers several embodiments are possible:

In some embodiments all impellers of the first multistage pump have the same specific speed.

In some embodiments all impellers of the second multistage pump have the same specific speed.

In some embodiments at least two impellers of the first multistage pump have a different specific speed.

In some embodiments at least two impellers of the second multistage pump have a different specific speed.

In some embodiments all impellers of the first multistage pump have the same specific speed, whereas the impellers of the second multistage pump are configured to have at least two different specific speeds.

In other embodiments all impellers of the second multistage pump have the same specific speed, whereas the impellers of the first multistage pump are configured to have at least two different specific speeds.

In some embodiments all impellers of the second multistage pump have a lower specific speed than the impellers of the first multistage pump.

Further advantageous measures and embodiments of the invention will become apparent from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
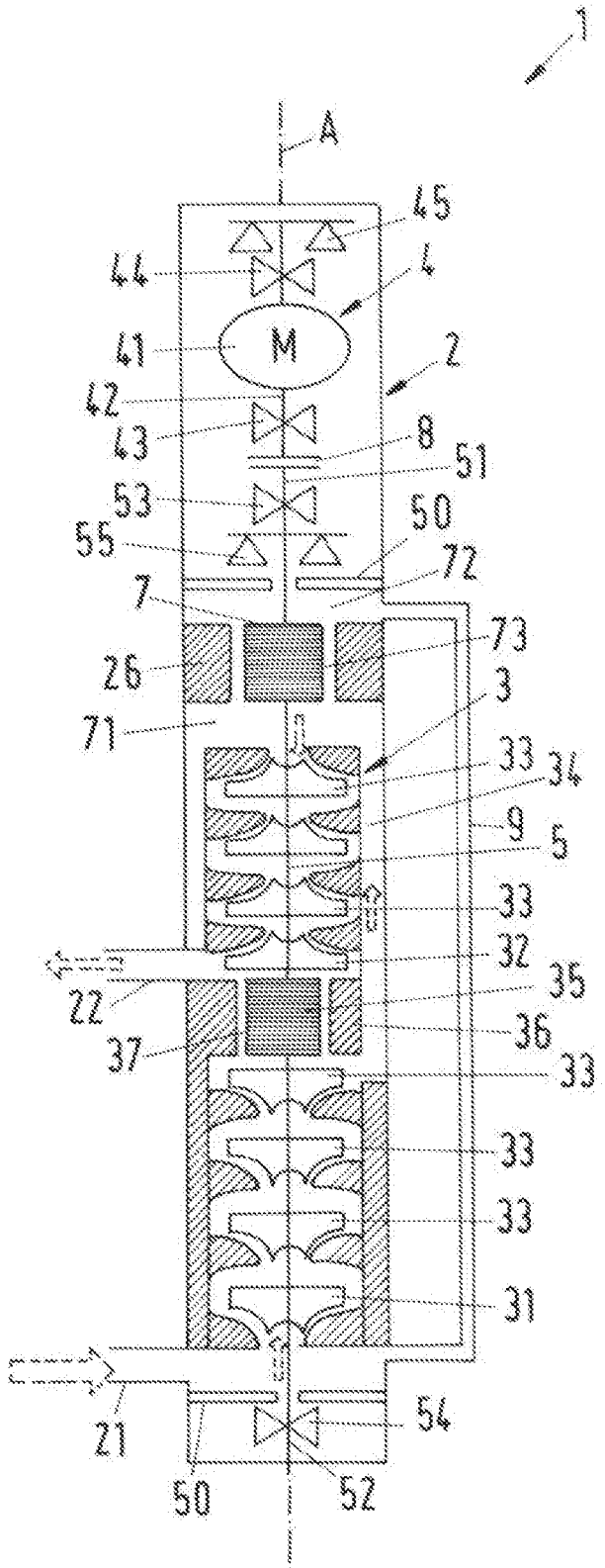
FIG. 1 is a schematic cross-sectional view of a first embodiment of a multistage pump according to the invention.

FIG. 1 shows a schematic cross-sectional view of a first embodiment of a multistage pump according to the invention, which is designated with reference numeral 1. The pump 1 is designed as a centrifugal pump for conveying a compressible fluid having a specific gravity of at most 0.9, preferably between 0.2 and 0.8, and has a common housing 2, a pump unit 3 and a drive unit 4. Both the pump unit 3 and the drive unit 4 are arranged within the common housing 2. The common housing 2 is designed as a pressure housing, which is able to withstand the pressure generated by the pump 1 as well as the pressure exerted on the pump 1 by the environment. The common housing 2 can comprise several housing parts, e.g. a pump housing and a drive housing, which are connected to each other to form the common housing 2 surrounding the pump unit 3 and the drive unit 4. It is also possible that the pump housing and the motor housing are inserted into the common housing 2. The common housing 2 is configured as a hermetically sealed pressure housing preventing any leakage to the external environment.

In particular, the multistage pump 1 is configured for conveying the compressible fluid being in the dense phase, i.e. in the supercritical phase or state. As to the meaning of "dense phase" and "supercritical phase" reference is made to FIG. 4, FIG. 5 and the explanations in the introduction of this application In the following description reference is made by way of example to the important application that the multistage pump 1 is designed and adapted for being used as a subsea injection pump 1 in the oil and gas industry, in particular for injecting a fluid being in the dense phase at least at the pump outlet 22 into a subterranean oil and/or gas reservoir to increase recovery of hydrocarbons from the subterranean region. The compressible fluid contains for example carbon dioxide ($CO_2$) and can contain also other constituents, such as natural gas, methane ($CH_4$) or the like. In addition, the compressible fluid can also comprise a certain amount of one or more liquid(s), for example water or oil. However, the content of liquid(s) should not exceed ten percent by volume and preferably is less than two percent by volume. Thus, the term "compressible fluid" is not restricted to a single substance, such as $CO_2$ but also encompasses mixtures e.g. mixtures in the dense phase or in the supercritical state. The term "compressible fluid" shall be understood in such a manner that the fluid in its entity behaves like a compressible fluid having a specific gravity relative to water which is at most 0.9 and preferably between 0.2 and 0.8. Preferably, the "compressible fluid" has a dynamic viscosity, which is comparable to the viscosity of a gas, and preferably at least 0.005 mPa·s and at most 0.1 mPa·s. The SI unit Millipascal times second corresponds to the also used unit Centipoise (cP), i.e. 1 mPa·s equals 1 cP. Particularly preferred, the compressible fluid contains at least 20 mol % of $CO_2$. In particular, a fluid in the dense state is a compressible fluid.

At a subsea location on a sea ground the $CO_2$ is for example separated from a stream of crude oil emerging from a production well of a subterranean oil field. More generally, a separation device separates the crude oil in a heavier phase having a higher density and a lighter phase having a lower density. The lighter phase is enriched with methane and carbon dioxide and the heavier phase comprises predominantly liquid hydrocarbons. The heavier phase is conveyed for example to a topside location for further processing. The lighter phase, which contains a considerable amount of $CO_2$, is fed to the multistage pump 1 and injected into a subterranean region of the oil field. Due to the pressure and temperature at the subsea location the $CO_2$ containing lighter phase is in the dense phase, i.e. in the supercritical state, at least when the lighter phase is discharged from the pump 1.

By injecting the fluid in the dense phase into the oil reservoir the hydrocarbons are forced to flow towards and out of the production well. The multistage pump 1 is in particular configured for installation on the sea ground, i.e. for use beneath the water surface, in particular down to a depth of 100 m, down to 1000 m or even down to more than 2000 m beneath the water surface of the sea.

The common housing 2 of the pump 1 comprises a pump inlet 21, through which the fluid enters the pump 1, and the pump outlet 22 for discharging the fluid with an increased pressure as compared to the pressure of the fluid at the pump inlet 21. Typically, the pump outlet 22 is connected to a pipe (not shown) for delivering the pressurized fluid to a well, in which the fluid is injected. The pressure of the fluid at the pump outlet 22 is referred to as 'high pressure' whereas the pressure of the fluid at the pump inlet 21 is referred to as 'low pressure'. A typical value for the difference between the high pressure and the low pressure is for example 100 to 200 bar (10-20 MPa).

The pump unit 3 further comprises a pump shaft 5 extending from a drive end 51 to a non-drive end 52 of the pump shaft 5. The pump shaft 5 is configured for rotating about an axial direction A, which is defined by the longitudinal axis of the pump shaft 5.

The pump unit 3 further comprises a plurality of impellers with a first stage impeller 31, a last stage impeller 32 and optionally a number of intermediate stage impellers 33. In the first embodiment the multistage pump is an eight stage pump having the first stage impeller 31, the last stage impeller 32 and six intermediate stage impellers 33, which are all arranged in series on the pump shaft 5. Of course, the number of eight stages is only exemplary. In other embodiments the multistage pump 1 can comprise more than eight stages, e.g. ten or twelve stages, or less than eight stages for example four or two stages.

The first stage impeller 31 is the first impeller when viewed in the direction of the streaming fluid, i.e. the first stage impeller 31 is located next to the pump inlet 21 at the low pressure side. The last stage impeller 32 is the last impeller when viewed in the direction of the streaming fluid, i.e. the last stage impeller 32 is located next to the pump outlet 22 at the high pressure side of the pump 1.

Each impeller 31, 32, 33 is fixedly mounted on the pump shaft 5 in a torque proof manner. The plurality of impellers 31, 32, 33 is arranged in series and configured for increasing the pressure of the fluid from the low pressure to the high pressure.

The drive unit 4 is configured to exert a torque on the drive end 51 of the pump shaft 5 for driving the rotation of the pump shaft 5 and the impellers 31, 32, 33 about the axial direction A.

The multistage pump 1 is configured as a vertical pump 1, meaning that during operation the pump shaft 5 is extending in the vertical direction, which is the direction of gravity. Thus, the axial direction A coincides with the vertical direction.

In other embodiments the multistage pump can be configured as a horizontal pump, meaning that during operation the pump shaft is extending horizontally, i.e. the axial direction A is perpendicular to the direction of gravity.

Figure 2:
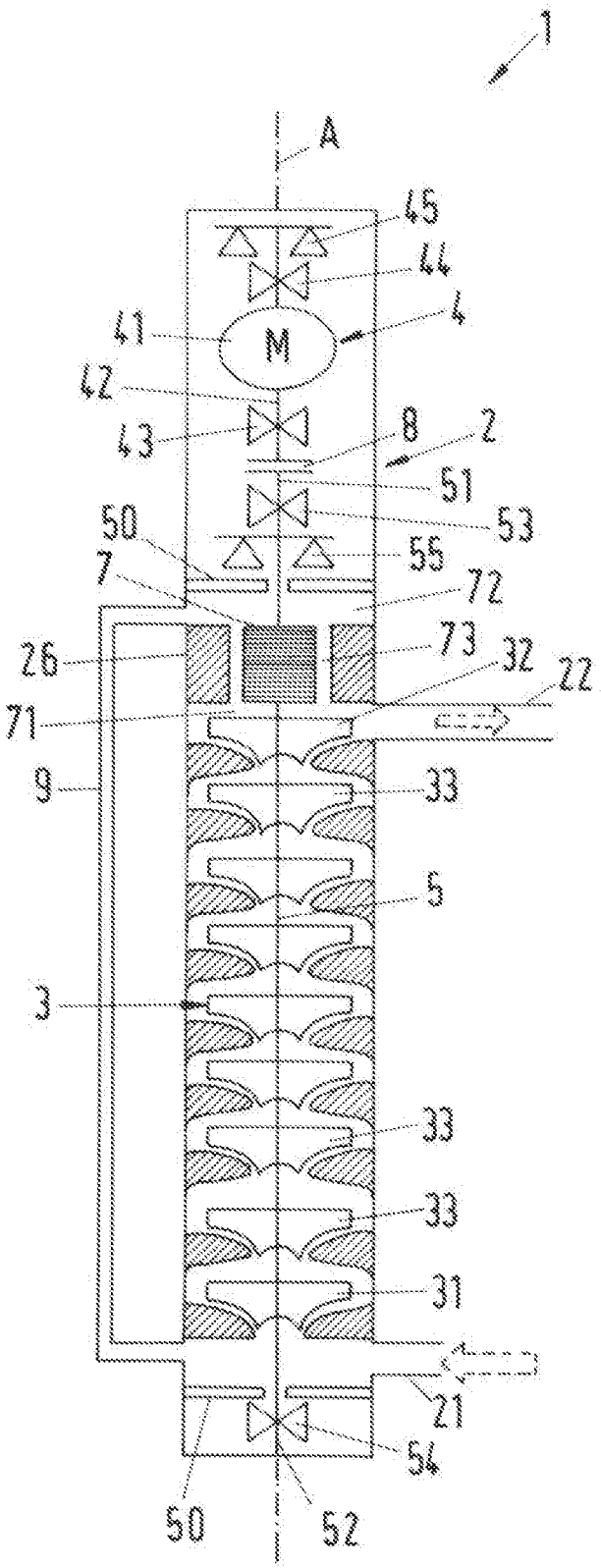
FIG. 2 is a schematic cross-sectional view of a second embodiment of a multistage pump according to the invention.
Figure 3:
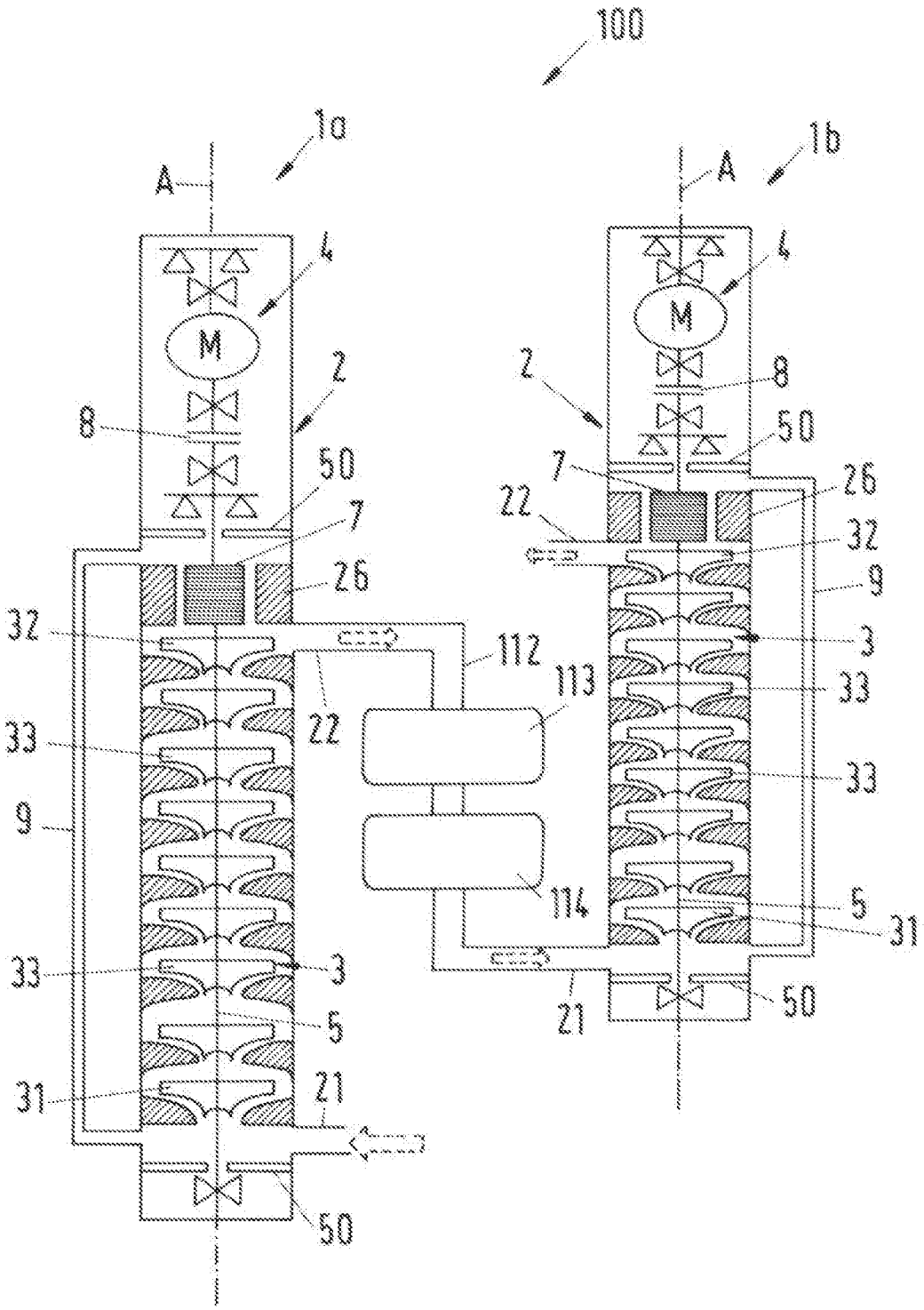
FIG. 3 is a schematic cross-sectional view of an embodiment of a subsea pumping arrangement according to the invention.

A direction perpendicular to the axial direction A is referred to as radial direction. The term 'axial' or 'axially' is used with the common meaning 'in axial direction' or 'with respect to the axial direction'. In an analogous manner the term 'radial' or 'radially' is used with the common meaning 'in radial direction' or 'with respect to the radial direction'. Hereinafter relative terms regarding the location like "above" or "below" or "upper" or "lower" or "top" or "bottom" refer to the usual operating position of the pump 1. FIG. 1-FIG. 3 show the pump 1 in the usual operating position.

Referring to this usual orientation during operation and as shown in FIG. 1 the drive unit 4 is located above the pump unit 3. However, in other embodiments the pump unit 3 can be located on top of the drive unit 4.

As can be seen in FIG. 1 the plurality of impellers 31, 32, 33 comprises a first set of impellers 31, 33 and a second set of impellers 32, 33, wherein the first set of impellers 31, 33 and the second set of impellers 32, 33 are arranged in a back-to-back arrangement. The first set of impellers 31, 33 comprises the first stage impeller 31 and the three intermediate impellers 33 of the next three stages and the second set of impellers 32, 33 comprises the last stage impeller 32 and the three intermediate impellers 33 of the three preceding stages. In other embodiments the first set of impellers can comprise a different number of impellers than the second set of impellers.

In a back-to-back arrangement the first set of impellers 31, 33 and the second set of impellers 32, 33 are arranged such that the axial thrust generated by the action of the rotating first set of impellers 31, 33 is directed in the opposite direction as the axial thrust generated by the action of the rotating second set of impellers 32, 33. As indicated in FIG. 1 by the dashed arrows without reference numeral, the fluid enters the multistage pump 1 through the pump inlet 21 located at the lower end of the pump section 3, passes the stages one (first stage), two, three and four, is then guided through a crossover line 34 to the suction side of the fifth stage at the upper end of the pump unit 3, passes the stages five, six, seven and eight (last stage), and is then discharged through the pump outlet 22, which is arranged between the upper end and the lower end of the pump unit 3.

For many applications the back-to-back arrangement is preferred because the axial thrust acting on the pump shaft 5, which is generated by the first set of impellers 31, 33 counteracts the axial thrust, which is generated by the second set of impellers 32, 33. Thus, the two axial thrusts compensate each other at least partially.

For further reducing the overall axial thrust acting on the pump shaft 5 the pump 1 can further comprise a balance drum 7 and/or a center bush 35. This will be explained in more detail hereinafter.

Each of the impellers 31, 32, 33 is configured as a radial impeller or as a semi-axial impeller 31, 32, 33. As it is commonly used in the art a radial impeller is configured to deflect the flow of fluid from the axial direction in a radial direction, and a semi-axial impeller is configured to deflect the flow of fluid from the axial direction in a direction, which has both an axial component and a radial component different from zero.

Each of the impellers 31, 32, 33 has a specific speed. As it is commonly used in the art, the specific speed $n_q$ of the respective impeller 31 or 32 or 33 of the respective stage is defined as $$n_q = n\ Q^{0.5}/H^{0.75}$$

wherein n denotes the rotational speed of the impeller in rounds per minute (rpm), Q denotes the flowrate in $m^3/s$ at the best efficiency point (BEP) and H denotes the head in m at the best efficiency point.

In some countries, e.g. in USA the specific speed $N_S$ is defined as $$N_S = n\ Q^{0.5}/H^{0.75}$$

wherein n denotes the rotational speed of the impeller in rounds per minute (rpm), Q denotes the flowrate in Gallon per minute (GPM) at the best efficiency point (BEP) and H denotes the head in feet (ft) at the best efficiency point.

Both $n_q$ and $N_S$ are quasi non-dimensional and used without dimension. By considering the different units that are used for $n_q$ and $N_S$ it follows that $$N_S = 51.6 n_q$$

It does not matter, whether $n_q$ or $N_S$ is used to specify the respective impeller, however for all impellers 31, 32, 33 of the pump 1 the same definition should be used, i.e. $n_q$ or $N_S$. In the following description the specific speed $n_q$ is used.

In some embodiments each impeller 31, 32, 33 of the plurality of impellers 31, 32, 33 has the same specific speed $n_q$. In other embodiments not all of the impellers 31, 32, 33 have the same specific speed $n_q$, i.e. there are at least two impellers 31 or 32 or 33 having a different specific speed $n_q$. It is also possible that all the impellers 31 and 32 and 33 have different specific speeds $n_q$. For such embodiments where at least two impellers 31 or 32 or 33 have different specific speeds $n_q$ it is preferred that the last stage impeller 32 has a lower specific speed than the first stage impeller 31. More generally, in embodiments where not all the impellers 31, 32, 33 have the same specific speed $n_q$ it is preferred that the specific speed of the impellers 31, 32, 33 decreases when going from the first stage impeller 31 to the last stage impeller 32. Of course, it is also possible that two or more adjacent impellers 31, 32, 33 have the same specific speed $n_q$, however, the specific speed $n_q$ should not increase when going from a lower stage having a lower discharge pressure to a higher stage having a higher discharge pressure. Thus, when viewed from the low pressure to the high pressure, the specific speed $n_q$ of the respective impellers 31, 32, 33 shall remain constant or decrease from one impeller to the next impeller, but not increase.

Typically, a compressible fluid having a specific gravity (relative to water) between 0.2 and 0.9 and having a low viscosity between 0.005 mPa·s and 0.1 mPa·s, such as a fluid in the dense state, has a behavior like a mixture between a liquid and a gas, namely the fluid has a high density like a liquid but a low viscosity as well as a high compressibility like a gas. Due to the high compressibility of the fluid the volume flow decreases with increasing pressure from stage to stage within the multistage pump 1. The volume flow is the highest at the low pressure, i.e. at the pump inlet 21, decreases from stage to stage, and is the lowest at the high pressure, when the fluid is discharged through the pump outlet 22. In order to compensate the decreasing volume flow caused by the compressibility of the fluid it is preferred that the plurality of impellers 31, 32, 33 comprises impellers of different specific speeds $n_q$ so that for each stage the respective flow is at least close to the BEP of this stage.

The pump 1 further comprises a plurality of bearings. A first radial pump bearing 53, a second radial pump bearing 54 and an axial pump bearing 55 are provided for supporting the pump shaft 5. The first radial pump bearing 53, which is the upper one, is arranged adjacent to the drive end 51 of the pump shaft 5 between the pump unit 3 and the drive unit 4. The second radial pump bearing 54, which is the lower one, is arranged between the pump unit 3 and the non-drive end 52 of the pump shaft 5 or at the non-drive end 52. The axial pump bearing 55 is arranged between the pump unit 3 and the first radial pump bearing 53. The pump bearings 53, 54, 55 are configured to support the pump shaft 5 both in axial and radial direction. The radial pump bearing 53 and 54 are supporting the pump shaft 5 with respect to the radial direction, and the axial bearing 55 is supporting the pump shaft 5 with respect to the axial direction A. The first radial pump bearing 53 and the axial pump bearing 55 are arranged such that the first radial pump bearing 53 is closer to the drive unit 4 and the axial pump bearing 55 is facing the pump unit 3. Of course, it is also possible, to exchange the position of the first radial pump bearing 53 and the axial pump bearing 55, i.e. to arrange the first radial pump bearing 53 between the axial pump bearing 55 and the pump unit 3, so that the axial pump bearing 55 is closer to the drive unit 4.

A radial bearing, such as the first or the second radial pump bearing 53 or 54 is also referred to as a "journal bearing" and an axial bearing, such as the axial pump bearing 55, is also referred to as an "thrust bearing". The first radial pump bearing 53 and the axial pump bearing 55 can be configured as separate bearings, but it is also possible that the first radial pump bearing 53 and the axial pump bearing 55 are configured as a single combined radial and axial bearing supporting the pump shaft 5 both in radial and in axial direction.

The second radial pump bearing 54 is supporting the pump shaft 5 in radial direction. In the embodiment shown in FIG. 1, there is no axial pump bearing provided at the non-drive end 52 of the pump shaft 5. Of course, in other embodiments it is also possible that an axial pump bearing for the pump shaft 5 is provided at the non-drive end 52. In embodiments, where an axial pump bearing is provided at the non-drive end 52, a second axial pump bearing can be provided at the drive end 51 or the drive end 51 can be configured without an axial pump bearing.

Preferably the radial pump bearings 53 and 54 as well as the axial pump bearing 55 are configured as hydrodynamic bearings, and even more preferred as tilting pad bearings 53, 54 and 55, respectively. Specifically preferred at least the first radial pump bearing 53 and the second radial pump bearing 54 are each configured as a radial tilting pad bearing. Of course, it is also possible that the first radial pump bearing 53 and the second radial pump bearing 54 are each configured as fixed multilobe hydrodynamic bearing.

Preferably, the multistage pump 1 comprises at least one balancing device for at least partially balancing the axial thrust that is generated by the impellers 31, 32, 33 during operation of the pump 1. The balancing device can comprise a balance drum 7 (also referred to as throttle bush) and/or a center bush 35. The first embodiment of the multistage pump 1 comprises the balance drum 7 and the center bush 35 for at least partially balancing the axial thrust that is generated by the impellers 31, 32, 33.

The balance drum 7 is fixedly connected to the pump shaft 5 in a torque proof manner. The balance drum 7 is arranged above the upper end of the pump unit 3, namely between the pump unit 3 and the drive end 51 of the pump shaft 5, more precisely between the upper end of the pump unit 3 and the axial pump bearing 55. The balance drum 7 defines a front side 71 and a back side 72. The front side 71 is the side facing the pump unit 3 and the impellers 33. In the first embodiment the front side 71 is facing the intermediate stage impeller 33 of the fifth stage. The back side 72 is the side facing the axial pump bearing 55 and the drive unit 4. The balance drum 7 is surrounded by a stationary part 26, so that a relief passage 73 is formed between the radially outer surface of the balance drum 7 and the stationary part 26. The stationary part 26 is configured to be stationary with respect to the common housing 2. The relief passage 73 forms an annular gap between the outer surface of the balance drum 7 and the stationary part 26 and extends from the front side 71 to the back side 72.

A balance line 9 is provided for recirculating the fluid from the back side 72 of the balance drum 7 to the low pressure side at the pump inlet 21. In particular, the balance line 9 connects the back side 72 with the low pressure side of the pump 1, where the low pressure, i.e. the pressure at the pump inlet 21 prevails. Thus, a part of the pressurized fluid passes from the front side 71 through the relief passage 73 to the back side 72, enters the balance line 9 and is recirculated to the low pressure side of the pump 1. The balance line 9 constitutes a flow connection between the back side 72 and the low pressure side at the pump inlet 21. The balance line 9 can be arranged—as shown in FIG. 1—outside the common housing 2. In other embodiments the balance line 9 can be designed as internal line completely extending within the common housing 2.

Due to the balance line 9 the pressure prevailing at the back side 72 is essentially the same—apart from a minor pressure drop caused by the balance line 9—as the low pressure prevailing at the pump inlet 21.

The axial surface of the balance drum 7 facing the front side 71 is exposed to an intermediate pressure between the low pressure and the high pressure. In the first embodiment shown in FIG. 1 the intermediate pressure is the suction pressure of the fifth stage prevailing at the outlet of the crossover line 34 during operation of the pump 1. Of course, due to smaller pressure losses the pressure prevailing at the axial surface of the balance drum 7 facing the front side 71 can be somewhat smaller than the intermediate pressure. However, the considerably larger pressure drop takes place over the balance drum 7. At the back side 72 it is essentially the low pressure that prevails during operation of the Thus, the pressure drop over the balance drum 7 is essentially the difference between the intermediate pressure and the low pressure.

The pressure drop over the balance drum 7 results in a force that is directed upwardly in the axial direction A and therewith counteracts the downwardly directed axial thrust generated by the first set of impellers 31, 33, namely the first stage impeller 31 and the intermediate impellers 33 of the second, third and fourth stage.

As a further balancing device for reducing the overall axial thrust acting on the pump shaft 5, a center bush 35 is arranged between the first set of impellers 31, 33 and the second set of impellers 33, 32. The center bush 35 is fixedly connected to the pump shaft 5 in a torque proof manner and rotates with the pump shaft 5. The center bush 35 is arranged on the pump shaft 5 between the last stage impeller 32, which is the last impeller of the second set of impellers, and the intermediate impeller 33 of the fourth stage, which is the last impeller of the first set of impellers, when viewed in the direction of increasing pressure, respectively.

The center bush 35 is surrounded by a second stationary part 36 being stationary with respect to the common housing 2. A annular balancing passage 37 is formed between the outer surface of the center bush 35 and the second stationary part 36.

The function of the center bush 35 and the balancing passage 37 is in principle the same as the function of the balance drum 7 and the relief passage 73. At the axial surface of the center bush 35 facing the last stage impeller 32 the high pressure prevails, and at the other axial surface facing the intermediate impeller 33 of the fourth stage a lower pressure prevails, which is essentially the same as the intermediate pressure when neglecting the small pressure losses caused by the crossover line 34. Therefore the fluid can pass from the last stage impeller 32 through the balancing passage 37 to the intermediate impeller 33 of the fourth stage.

The pressure drop over the center bush 35 essentially equals the difference between the high pressure and the intermediate pressure. The pressure drop over the center bush results in a force that is directed downwardly in the axial direction A and therewith counteracts the upwardly directed axial thrust generated by the second set of impellers 33, 32, namely the intermediate impellers 33 of the fifth, sixth and seventh stage and the last stage impeller 32.

The drive unit 4 comprises an electric motor 41 and a drive shaft 42 extending in the axial direction A. For supporting the drive shaft 42 a first radial drive bearing 43, a second radial drive bearing 44 and an axial drive bearing 45 are provided, wherein the second radial drive bearing 44 and the axial drive bearing 45 are arranged above the electric motor 41 with respect to the axial direction A, and the first radial drive bearing 43 is arranged below the electric motor 41. The electric motor 41, which is arranged between the first and the second radial drive bearing 43, 44, is configured for rotating the drive shaft 42 about the axial direction A. The drive shaft 42 is connected to the drive end 51 of the pump shaft 5 by a coupling 8 for transferring a torque to the pump shaft 5.

The drive bearings 43, 44 and 45 are configured to support the drive shaft 42 both in radial direction and in the axial direction A. The first and the second radial drive bearing 43, 44 support the drive shaft 42 with respect to the radial direction, and the axial drive bearing 45 supports the drive shaft 42 with respect to the axial direction A. The second radial drive bearing 44 and the axial drive bearing 45 are arranged such that the second radial drive bearing 44 is arranged between the axial drive bearing 45 and the electric motor 41.

Of course, it is also possible, to exchange the position of the second radial drive bearing 44 and the axial drive bearing 45.

The second radial drive bearing 44 and the axial drive bearing 45 can be configured as separate bearings, but it is also possible that the second radial drive bearing 44 and the axial drive bearing 45 are configured as a single combined radial and axial bearing supporting the drive shaft 42 both in radial and in axial direction A.

The first radial drive bearing 43 is arranged below the electric motor 41 and supports the drive shaft 42 in radial direction. In the embodiment shown in FIG. 1, there is no axial bearing arranged below the electric motor 41. Of course, it is also possible that an axial drive bearing for the drive shaft 42 is—alternatively or additionally—arranged below the electric motor 41, i.e. between the electric motor 41 and the coupling 8.

The electric motor 41 of the drive unit 4 can be configured as a cable wound motor. In a cable wound motor the individual wires of the motor stator (not shown), which form the coils for generating the electromagnetic field(s) for driving the motor rotor (not shown), are each insulated, so that the motor stator can be flooded for example with a barrier fluid. Alternatively, the electric motor 41 can be configured as a canned motor. When the electric drive 41 is configured as a canned motor, the annular gap between the motor rotor and the motor stator of the electric motor 41 is radially outwardly delimited by a can (not shown) that seals the motor stator hermetically with respect to the motor rotor and the annular gap. Thus, any fluid flowing through the gap between the motor rotor and the motor stator cannot enter the motor stator. When the electric motor 41 is designed as a canned motor a dielectric cooling fluid can be circulated through the hermetically sealed motor stator for cooling the motor stator.

Preferably, the electric motor 41 is configured as a permanent magnet motor or as an induction motor. To supply the electric motor 41 with energy, a power penetrator (not shown) is provided at the common housing 2 for receiving a power cable (not shown) that supplies the electric motor 41 with power.

The electric motor 41 can be designed to operate with a variable frequency drive (VFD), in which the speed of the motor 41, i.e. the frequency of the rotation, is adjustable by varying the frequency and/or the voltage supplied to the electric motor 41. However, it is also possible that the electric motor 41 is configured differently, for example as a single speed or single frequency drive.

The drive shaft 42 is connected to the drive end 51 of the pump shaft 5 by the coupling 8 for transferring a torque to the pump shaft 5. Preferably the coupling 8 is configured as a flexible coupling 8, which connects the drive shaft 42 to the pump shaft 5 in a torque proof manner, but allows for a relative lateral (radial) and/or axial movement between the drive shaft 42 and the pump shaft 5. Thus, the flexible coupling 8 transfers the torque but no or nearly no lateral vibrations. Preferably, the flexible coupling 8 is configured as a mechanical coupling 8. In other embodiments the flexible coupling can be designed as a magnetic coupling, a hydrodynamic coupling or any other coupling that is suited to transfer a torque from the drive shaft 42 to the pump shaft 5.

The multistage pump 1 further comprises two sealing units 50 for sealing the pump shaft 5 against a leakage of the fluid along the pump shaft 5. By the sealing units 50 the fluid is prevented from entering the drive unit 4 as well as the pump bearings 53, 54, 55. One of the sealing units 50 is arranged between the balance drum 7 and the axial pump bearing 55 and the other sealing unit 50 is arranged between the first stage impeller 31 and the second radial pump bearing 54. Preferably each sealing unit 50 comprises a mechanical seal. Mechanical seals are well-known in the art in many different embodiments and therefore require no detailed explanation. In principle, a mechanical seal is a seal for a rotating shaft and comprises a rotor fixed to the pump shaft 5 and rotating with the pump shaft 5, as well as a stationary stator fixed with respect to the common housing 2. During operation the rotor and the stator are sliding along each other—usually with a liquid there between—for providing a sealing action to prevent the fluid from escaping to the environment or entering the drive unit 4 of the pump 1.

For the lubrication and the cooling of the sealing units 50 and the pump bearings 53, 54, 55 as well as for the cooling of the drive unit 4 a barrier fluid system (not shown) is provided. Barrier fluid systems as such are well-known in the art since many years and therefore do not require a detailed explanation. A barrier fluid system comprises a reservoir for a barrier fluid as well as a circuit through which the barrier fluid is moved. The circuit is designed e.g. such that the barrier fluid passes through the drive unit 4, the pump bearings 53, 54, 55 and the sealing units 50. The barrier fluid system can also comprise a heat exchanger for cooling the barrier fluid as well as a pressure control device for controlling the pressure of the barrier fluid in the circuit. The pressure of the barrier fluid in the circuit is controlled such that the pressure of the barrier fluid is at least as high as but preferably higher than a reference pressure of the process fluid, here the compressible fluid. According to a preferred configuration, the pressure of the barrier fluid in the circuit is higher than the low pressure at the pump inlet 21.

By this measure there is always a leakage flow of barrier fluid through the sealing units 50 into the pump unit 3. Therefore any leakage flow of the fluid from the pump unit 3 through the sealing units 50 into the drive unit 4 or the pump bearings 53, 54, 55 is reliably prevented. The amount of barrier fluid, that is lost by the leakage into the pump unit 3 is replaced from the reservoir for the barrier fluid.

In other embodiments the multistage pump 1 is designed as a process fluid lubricated pump, which does not require a separate barrier fluid that is different from the process fluid, here the compressible fluid. In such embodiments the multistage pump 1 is preferably designed as a seal-less pump, i.e. without the two sealing units 50. The seal-less multistage pump 1 has no mechanical seals.

The term "process fluid lubricated pump" refers to pumps, where the process fluid that is conveyed by the pump 1 is used for the lubrication and the cooling of components of the pump, e.g. bearing units. It is known to use the process fluid as such or a fluid that is produced from the process fluid, e.g. by phase separation or phase enrichment. A process fluid lubricated pump does not require a specific barrier fluid different from the process fluid to avoid leakage of the process fluid e.g. into the drive unit 4, because the process fluid or the fluid produced from the process fluid is deliberately allowed to enter the drive unit 4 and is used for cooling and lubricating components of the pump 1 such as the pump bearings 53, 54 and 55. In addition, a process fluid lubricated pump 1 does not require a lubricant different from the process fluid for the lubrication of the pump components.

In other embodiments (not shown) a further balance drum can be arranged below the lower end of the pump unit 3, namely between the pump unit 3 and the non-drive end 52 of the pump shaft 5, more precisely between the lower end of the pump unit 3 and the second radial pump bearing 54. In still other embodiments a balance drum is provided only at the lower end of the pump 1, between the pump unit 3 and the second radial pump bearing 54 at the non-drive end 52 of the pump shaft 5 and no balance drum is provided above the pump unit 3 near the drive end 51 of the pump shaft 5. In all these embodiments the center bush 35, the second stationary part 36 and the balancing passage 37 in between are optional features, i.e. the multistage pump 1 can be designed with or without these features.

FIG. 2 shows a schematic cross-sectional view of a second embodiment of a multistage pump 1 according to the invention.

In the following description of the second embodiment of the multistage pump 1 only the differences to the first embodiment are explained in more detail. The explanations with respect to the first embodiment and variants thereof are also valid in the same way or in analogously the same way for the second embodiment. Same reference numerals designate the same features that have been explained with reference to the first embodiment or functionally equivalent features.

Compared to the first embodiment, it is the main difference, that the second embodiment of the pump 1 is designed with an inline arrangement of all impellers 31, 32, 33. In an inline arrangement all impellers 31, 32, 33 are configured such that the axial thrusts generated by the individual rotating impellers 31, 32, 33 are all directed in the same direction, namely downwards in the axial direction A in FIG. 2. The plurality of impellers 31, 32, 33 in FIG. 2 can be considered as including a first set of impellers 31, 33 comprising the first stage impeller 31 and some of the intermediate stage impellers 33 and a second set of impellers 33, 32 comprising the remaining intermediate stage impellers 33 and the last stage impeller 32. Then, the axial thrust generated by the first set of impellers 31, 33 is directed in the same direction as the axial thrust generated by the second set of impellers 33, 32. In addition, the flow of the fluid from the pump inlet 21 (low pressure) towards the pump outlet 22 (high pressure) is always directed in the same direction, namely in upward direction, and does not change as in the back-to-back arrangement (FIG. 1).

Therefore, the second embodiment does not have the crossover line 34. In addition, the pump outlet 22 is arranged at the upper end of the pump unit 3 in the second embodiment.

Furthermore, the second embodiment is designed as a nine stage pump 1, having the first stage impeller 31, the last stage impeller 32 and seven intermediate stage impellers 33.

The balance drum 7 is arranged at the upper end of the pump unit 3 adjacent to the last stage impeller 32, namely between the last stage impeller 32 and the drive end 51 of the pump shaft 5. The front side 71 of the balance drum 7 is in fluid communication with the pump outlet 22. The balance line 9 is provided for recirculating the fluid from the back side 72 of the balance drum 7 to the low pressure side at the pump inlet 21. Due to the balance line 9 the pressure prevailing at the back side 72 is essentially the same—apart from a minor pressure drop caused by the balance line 9—as the low pressure prevailing at the pump inlet 21.

The axial surface of the balance drum 7 facing the front side 71 is exposed to the high pressure prevailing at the pump outlet 22. Thus, the pressure drop over the balance drum 7 essentially equals the pressure difference between the high pressure at the pump outlet 22 and the low pressure at the pump inlet 21.

Of course, due to smaller pressure losses the pressure prevailing at the axial surface of the balance drum 7 facing the front side 71 can be somewhat smaller than the high pressure. However, the considerably larger pressure drop takes place over the balance drum 7.

The pressure drop over the balance drum 7 results in a force that is directed upwardly in the axial direction A and therewith counteracts the downwardly directed axial thrust generated by the plurality of impellers 31, 32, 33.

The second embodiment does not comprise the center bush 35, the second stationary part 36 and the balancing passage 37. However, in other embodiments with an inline arrangement of the impellers there can be provided a center bush between two adjacent impellers.

Both for an inline arrangement (FIG. 2) and for a back-to-back arrangement (FIG. 1) the number of individual impellers 31, 32, 33 forming the first set of impellers 31, 33 and the number of individual impellers forming the second set of impellers 33, 32 can be different or can be the same. It depends on the respective application, whether the first set and the second set have the same number of impellers or whether the first set of impellers has a different number of impellers than the second set of impellers.

FIG. 3 shows a schematic cross-sectional view of an embodiment of a subsea pumping arrangement according to the invention, which is designated in its entity with reference numeral 100.

The subsea pumping arrangement 100 is configured for installation on a sea ground and comprises at least a first multistage pump 1*a* and a second multistage pump 1*b*. Each of the multistage pumps 1*a*, 1*b* is configured as a multistage pump 1 according to embodiments of the invention. Each of the first multistage pump 1*a* and the second multistage pump 1*b* can be configured for example as explained with respect to the first embodiment of the multistage pump 1 according to the invention (FIG. 1) or as explained with respect to the second embodiment of the multistage pump 1 according to the invention (FIG. 2). The first multistage pump 1*a* and the second multistage pump 1*b* can be configured in an identical manner or they can be configured in different manners. Just as an example, the first multistage pump 1*a* can be configured according to the first embodiment shown in FIG. 1 and the second multistage pump 1*b* can be configured according to the second embodiment shown in FIG. 2.

In the embodiment illustrated in FIG. 3 both the first multistage pump 1*a* and the second multistage pump 1*b* are configured with nine stages and an inline arrangement of the impellers 31, 32, 33.

As can be seen in FIG. 3 the first multistage pump 1*a* and the second multistage pump 1*b* are arranged in series.

The subsea pumping arrangement 100 is in particular advantageous for applications, where a high injection pressure is required. For such applications it can be more efficient to arrange two or more multistage pumps 1*a*, 1*b* in series rather than adding additional stages to a single multistage pump 1.

The pump outlet 22 of the first multistage pump 1*a* is connected to the pump inlet 21 of the second multistage pump 1*b* by a piping 112. In some embodiments the pump outlet 22 of the first multistage pump 1*a* is directly connected to the pump inlet 21 of the second multistage pump 1*b* without any additional device in between. In other embodiments—as it is shown in FIG. 3—one or more additional device(s) 113, 114 is/are arranged between the pump outlet 22 of the first multistage pump 1*a* and the pump inlet 21 of the second multistage pump 1*b*. In the embodiment illustrated in FIG. 3 the outlet 22 of the first multistage pump 1*a* is connected to a cooling device 113. From the cooling device 113 the pressurized fluid is guided to a buffer 114. The outlet of the buffer 114 is connected to the inlet 21 of the second multistage pump 1*b*. The outlet 22 of the second multistage pump 1*b* is connected to a well (not shown) leading to a subterranean region, in which the fluid, e.g. the carbon dioxide, is injected.

Regarding the design of the impellers 31, 32, 33 of the first multistage pump 1*a* and the second multistage pump 1*b* several embodiments are possible. According to a first variant all impellers 31, 32, 33 of the first multistage pump 1*a* are configured to have the same first specific speed no and all impellers 31, 32, 33 of the second multistage pump 1*b* are configured to have the same second specific speed $n_{q2}$, wherein the first specific speed no is higher than the second specific speed $n_{q2}$ to account for the high compressibility of the fluid, i.e. $n_{q1}>n_{q2}$.

According to another variant all impellers 31, 32, 33 of the first multistage pump 1*a* are configured to have the same specific speed no and the impellers 31, 32, 33 of the second multistage pump 1*b* are configured to have at least two different specific speeds.

In still another variant all impellers 31, 32, 33 of the second multistage pump 1*b* are configured to have the same specific speed $n_{q2}$ and the impellers 31, 32, 33 of the first multistage pump 1*a* are configured to have at least two different specific speeds.

In still another variant the impellers 31, 32, 33 of the first multistage pump 1*a* are configured to have at least two different specific speeds, and the impellers 31, 32, 33 of the second multistage pump 1*b* are configured to have at least two different specific speeds.

Irrespective of whether all impellers 31, 32, 33 of the first multistage pump 1*a* are configured to have the same specific speed or not and irrespective of whether all impellers 31, 32, 33 of the second multistage pump 1*b* are configured to have the same specific speed or not, it is preferred that none of the impellers 31, 32, 33 of the second multistage pump 1*b* has a higher specific speed than any of the impellers 31, 32, 33 of the first multistage pump 1*a*.

Furthermore, the subsea pumping arrangement 100 according to the invention can also comprise more than two multistage pumps 1*a*, 1*b*. Preferably, all multistage pumps of the subsea pumping arrangement 100 are arranged in series.

Figure 4:
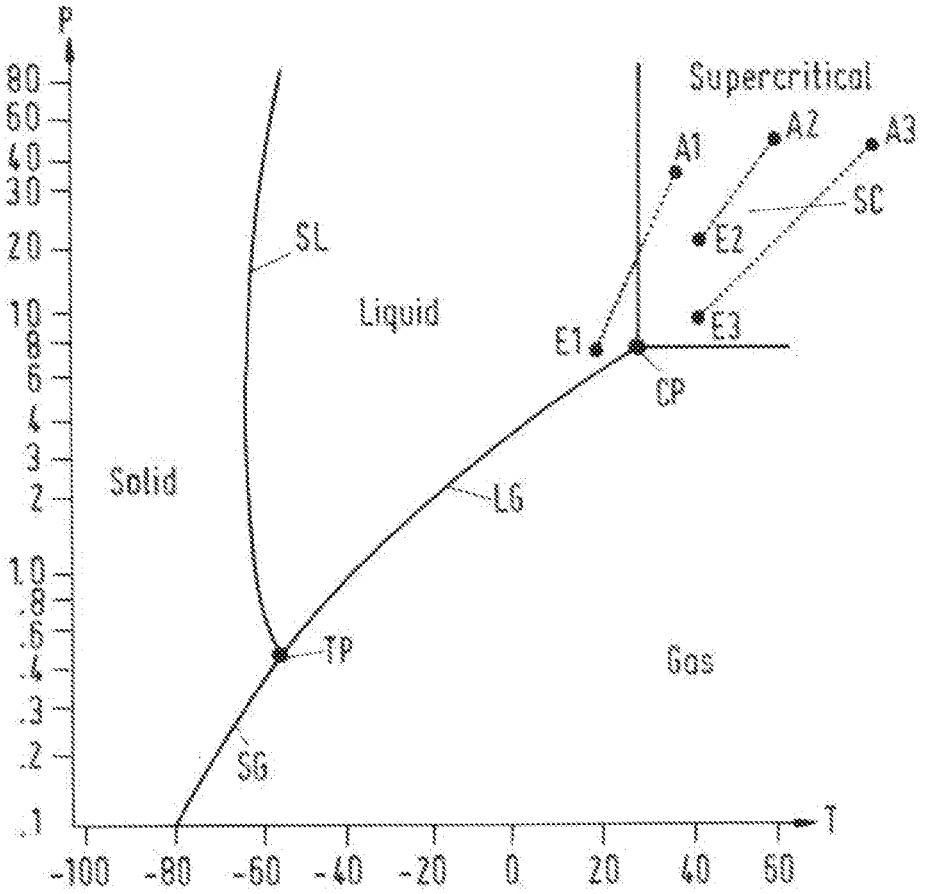
FIG. 4 is a schematic representation of the phase diagram of pure $CO_2$ (single component fluid)
Figure 5:
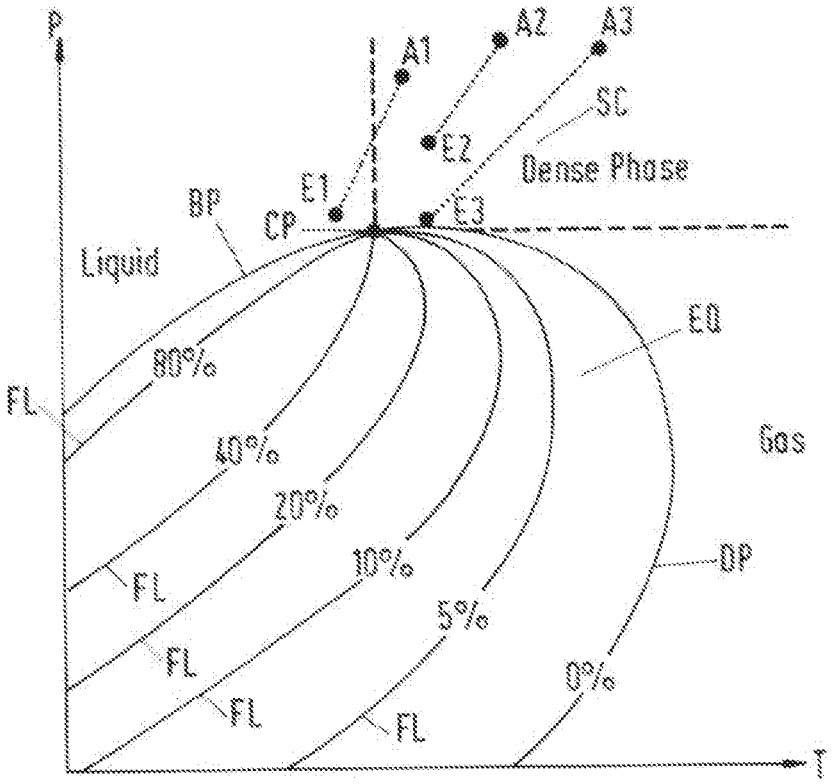
FIG. 5 is similar to FIG. 4, but for a multi-component fluid at one defined composition.

The phase diagrams in FIG. 4 and FIG. 5 have already been explained in the introduction. Both in FIG. 4 and in FIG. 5 points E1, E2, E3 are shown, which are connected in each case by a dotted line to point A1 or point A2 or point A3, respectively. The indices 1, 2, 3 refer to three different applications or designs of the multistage pump 1. The points E1, E2, E3 indicate the particular state (pressure, temperature) of the fluid at the pump inlet 21, and the points A1, A2 and A3, respectively indicate the particular state (pressure, temperature) of the fluid at the pump outlet 22 for the same application or design of the pump 1. As can be seen for the application represented by the points E1 and A1 the fluid is in the liquid phase at the pump inlet 21 and in the dense phase at the pump outlet 22. For the two other applications represented by the points E2, A2 and the points E3 and A3 the fluid is in the dense phase, both at the pump inlet 21 and at the pump outlet.

Furthermore, a multistage pump is proposed, configured for installation on a sea ground, having a common housing, a pump unit arranged in the common housing, and a drive unit arranged in the common housing, wherein the pump unit is configured for conveying a compressible fluid having a specific gravity of at most 0.9, wherein the common housing comprises a pump inlet and a pump outlet, wherein the pump unit comprises a plurality of impellers for conveying the compressible fluid from the pump inlet to the pump outlet, and a pump shaft, on which each impeller is mounted, wherein each impeller is configured as a radial or semi-axial impeller, wherein the drive unit comprises a drive shaft for driving the pump shaft, and an electric motor for rotating the drive shaft about an axial direction, and wherein a coupling is provided for coupling the drive shaft to the pump shaft.

Preferably, in said multistage pump at least two impellers (31, 32, 33) of the plurality of impellers (31, 32, 33) have a different specific speed.

What is claimed:

1. A multistage pump configured for installation on a sea ground, comprising:

a common housing configured to withstand subsea pressure exerted at least at a depth of 100 meters;

a pump unit arranged in the common housing;

a drive unit arranged in the common housing, the common housing comprising a pump inlet and a pump outlet, the pump unit comprising a plurality of impellers configured to convey a compressible fluid from the pump inlet to the pump outlet, the pump outlet being an only opening through which the conveyed compressible fluid is capable of exiting the common housing, and a pump shaft, on which each impeller of the plurality of impellers is mounted, each said impeller is a radial or semi-axial impeller, the drive unit comprising a drive shaft configured to drive the pump shaft, and an electric motor configured to rotate the drive shaft about an axial direction;

a seal disposed between the pump unit and the drive unit to seal around the pump shaft; and a coupling disposed in a portion of the common housing with the drive unit and configured to couple the drive shaft to the pump shaft, such that the pump shaft extends from the portion of the common housing with the drive unit through the seal and into a portion of the common housing with the pump unit, the pump unit configured to convey the fluid being in a dense phase at the pump outlet, and at least two impellers of the plurality of impellers have a different specific speed, the plurality of impellers comprising a first stage impeller and a last stage impeller, and the last stage impeller having a lower specific speed than the first stage impeller.

2. The multistage pump in accordance with claim 1, wherein the multistage pump is an injection pump configured to inject the compressible fluid in the dense state into a subterranean region.

3. The multistage pump in accordance with claim 1, further comprising a balance drum, which is fixedly connected to the pump shaft between the pump unit and the coupling, the balance drum defining a front side facing the pump unit and a back side, a relief passage is disposed between the balance drum and a stationary part configured to be stationary with respect to the common housing, the relief passage extending from the front side to the back side, and a balance line is disposed and configured to recirculate the fluid from the back side to a low pressure side of the multistage pump.

4. The multistage pump in accordance with claim 1, wherein the plurality of impellers comprises a first set of impellers and a second set of impellers, the first set of impellers and the second set of impellers are arranged in a back-to-back arrangement, so that an axial thrust generated by the first set of impellers is directed opposite to an axial thrust generated by the second set of impellers.

5. The multistage pump in accordance with claim 4, further comprising a center bush fixedly connected to the pump shaft between the first set of impellers and the second set of impellers, and a balancing passage is disposed between the center bush and a second stationary part configured to be stationary with respect to the common housing.

6. The multistage pump in accordance with claim 1, wherein the multistage pump is a vertical pump with the pump shaft extending in the direction of gravity, and the drive unit is arranged on top of the pump unit.

7. The multistage pump in accordance with claim 1, wherein the multistage pump is to inject a mixture containing at least 20 mol % of carbon dioxide into a subterranean region.

8. The multistage pump in accordance with claim 1, wherein the multistage pump is as a single phase pump configured to convey a single phase fluid.

9. The multistage pump in accordance with claim 1, wherein the relief passage extends along the same direction as an axis of rotation of the pump shaft, radially externally of the balance drum and radially internally of the stationary part.

10. A subsea pumping arrangement configured for installation on a sea ground, comprising:

at least a first multistage pump and a second multistage pump, each multistage pump is configured as the multistage pump according to claim 1, and the first multistage pump and the second multistage pump are arranged in series.

11. The subsea pumping arrangement in accordance with claim 10, wherein all impellers of the plurality of impellers of the second multistage pump have a lower specific speed than the impellers of the plurality of impellers of the first multistage pump.

* * * * *